United States Patent [19]

Hata et al.

[11] Patent Number: 4,704,216

[45] Date of Patent: Nov. 3, 1987

[54] LUBRICANT COMPOSITION FOR TRANSMISSION OF POWER

[75] Inventors: Hitoshi Hata, Sodegaura; Hisashi Machida, Maebashi; Tomoo Ishihara, Tokyo, all of Japan

[73] Assignee: Idemitsu Kosan Company Limited, Tokyo, Japan

[21] Appl. No.: 899,882

[22] Filed: Aug. 25, 1986

[30] Foreign Application Priority Data

Sep. 3, 1985 [JP] Japan ..... 60-193191

[51] Int. Cl.[4] ..... C10M 137/06

[52] U.S. Cl. ..... 252/32.7 E; 252/33.3; 252/51.5 A; 585/3

[58] Field of Search ..... 252/32.7 E, 51.5 A, 252/33.3; 585/3, 2

[56] References Cited

U.S. PATENT DOCUMENTS

| | | | |
|---|---|---|---|
| 3,835,050 | 9/1974 | Green | 585/3 |
| 3,920,562 | 11/1975 | Foehr | 252/32.7 E |
| 3,925,217 | 12/1975 | Green et al. | 585/2 |
| 4,306,984 | 12/1981 | Yamaguchi | 252/46.7 |
| 4,371,726 | 2/1983 | Horita | 252/32.7 E |

*Primary Examiner*—Jacqueline V. Howard
*Attorney, Agent, or Firm*—Walter H. Schneider

[57] ABSTRACT

A lubricant composition for transmission of power consisting essentially of (A) base oil of which main component is a saturated hydrocarbon having condensed ring and/or non-condensed ring, (B) one kind or more than two kinds of zinc dithiophosphate and/or oxymolybdenum organophosphorodithioate sulfide, and (C) at least one kind of compound selected from the group consisting of phosphoric ester, phosphorous ester and their amine salts.

16 Claims, No Drawings

LUBRICANT COMPOSITION FOR TRANSMISSION OF POWER

BACKGROUND OF THE INVENTION

This invention relates to lubricant compositions for transmission of power, and more particularly to lubricant compositions having excellent durability and high traction coefficient and can be utilized effectively for practical purpose as lubricants for power transmission having a traction drive mechanism.

In recent years, traction drive (friction driving device utilizing rolling contact) is employed as continuously variable transmission for automobile and industrial equipment, etc. As the fluid used for the traction drive, a fluid having high traction coefficient and high power transmitting efficiency is required.

Under the circumstances, a variety of proposals are made in order to obtain fluid for traction drive having high power transmitting efficiency (for example, Japanese Patent Publications Nos. 46-338, 46-339, 47-35763, 53-36105, 58-27838, Japanese Patent Laid-open Publications Nos. 55-40726, 55-43108, 55-60596, 55-78089, 55-78095, 57-155295, 57-155296, 57-162795 and the like).

It is necessary to lubricate the traction drive mechanism with a single oil since said traction drive mechanism is constituted as an apparatus for transmission of power containing gear mechanism, oil pressure mechanism, rolling bearings, etc. in the same system.

However, the lubricants for transmission of power mentioned above are not useful for practical purposes, if they do not give durability to metal materials which constitute the traction drive mechanism, gears, bearings and the like. To give the durability to the materials, it is indispensable to render excellent load carrying capacity and wear resistance against the metal material and to prolong the fatigue life of the metal material in addition to the foregoing characteristics, and moreover, it is necessary that lubricant has satisfactory oxidation stability of the lubricant and particularly, has no generation of sludge. And yet, the lubricant gives preferably excellent rust resistance against the metal material without disturbing these performances.

However, the conventional fluid for traction drive enumerated in the foregoing deteriorates the durability of the metal material constituting the traction drive mechanism, gears, bearings and the like remarkably although its power transmitting efficiency is improved, and is not suitable for use due to occurrence of seizure, wear or fatigue damage or deteriorates the thermal oxidation stability of the lubricant, and particularly, does not withstand sufficiently for practical use because of operation defect upon generation of a large amount of sludge.

Under the circumstances, in order to overcome the foregoing conventional problems, blending of the additives such as extreme pressure additive, antiwear agent, antioxidant to the fluid for traction drive described in the foregoing is considered.

But, when an additive such as extreme pressure additive is merely added to the fluid for traction drive, problems such as shortening the fatigue life of the traction drive mechanism or remarkably deteriorating the power transmitting efficiency or causing corrosion, and as a result, the lubricant capable of satisfying sufficiently all the characteristics which are appropriate for practical purpose has not been available.

SUMMARY OF THE INVENTION

An object of this invention is to eliminate the foregoing conventional problems and to provide lubricant compositions for transmission of power capable of effectively utilizing for practical purpose the lubrication for the power transmission having a traction drive mechanism which has excellent traction coefficient and high power transmitting efficiency and improving durability by rendering wear resistance, load carrying capacity and fatigue life to the metal itself constituting the traction drive mechanism and also having high oxidation stability and rust preventing property.

DETAILED DESCRIPTION OF THE INVENTION

This invention is to provide, in the first place, a lubricant composition for transmission of power which consists essentially of (A) a base oil whose main component is a saturated hydrocarbon having condensed ring and/or non-condensed ring, (B) one kind or more than two kinds of zinc dithiophosphate represented by the following general formula

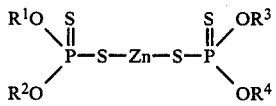

(I)

(In which $R^1$, $R^2$, $R^3$ and $R^4$ denote a primary alkyl group of 3–30 carbon atoms, secondary alkyl group of 3–30 carbon atoms, or aryl group of 6–30 carbon atoms or alkyl group substituted aryl group. Provided that $R^1$, $R^2$, $R^3$ and $R^4$ may be the same or different.) and/or oxymolybdenum organo phosphorodithioate sulfide represented by the following general formula

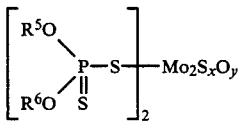

(II)

(In which $R^5$ and $R^6$ denote an alkyl group of 1–30 carbon atoms, cycloalkyl group, aryl group or alkylaryl group, and x and y denote a positive real number satisfying $x+y=4$. Provided that $R^5$ and $R^6$ may be the same or different.) and (C) at least one kind of compounds chosen from phosphoric ester, phosphorous ester and their amine salts.

This invention is to provide, in the second place, a lubricant composition for transmission of power in which a rust inhibitor is blended as (D) component to the above first invention.

In this invention, as (A) component, the base oil whose main component is a saturated hydrocarbon having condensed ring and/or non-condensed ring is used. As the saturated hydrocarbon mentioned above, a variety of compounds can be enumerated, but particularly, the saturated hydrocarbon having the cyclohexyl group and/or decalyl group, and the saturated hydrocarbon of 10–40 carbon atoms is preferable. As the saturated hydrocarbon having the cyclohexyl group and/or decalyl group, concretely speaking, the following compounds can be enumerated.

Namely, for example, 2-methyl-2,4-dicyclohexyl butane represented by the following formula

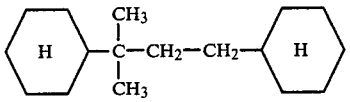

1-decalyl-1-cyclohexyl ethane represented by the following formula

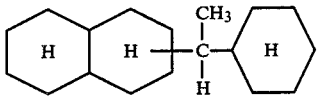

2-methyl-2,4-dicyclohexyl pentane represented by the following formula

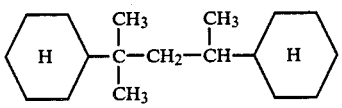

alkyl cyclohexane represented by the following formula

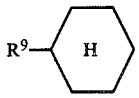

(In which $R^9$ denotes an alkyl group of 10–30 carbon atoms.) can be enumerated. As the example compounds, concretely speaking, isododecylcyclohexane, isopentadecylcyclohexane and the like can be enumerated.

Besides, as the saturated hydrocarbon having condensed ring and/or non-condensed ring which is the (A) component in this invention, the following compounds can be enumerated.

Namely, 1,2-di(dimethylcyclohexyl)propane represented by the following formula

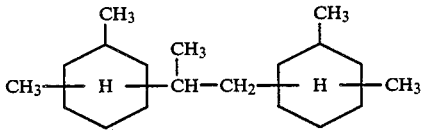

2,3-di(methylcyclohexyl)-2-methylbutane represented by the following formula

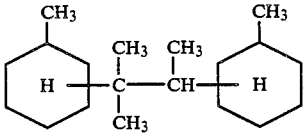

1,2-di(methylcyclohexyl)-2-methylpropane represented by the following formula

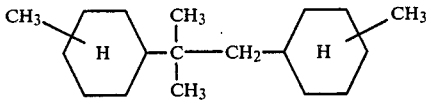

2,4-dicyclohexylpentane represented by the following formula

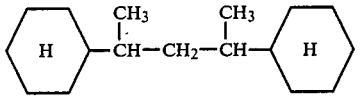

cyclohexyl methyl decalin represented by the following formula

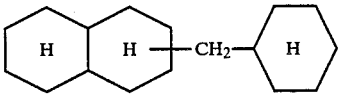

1-(methyldecalyl)-1-cyclohexyl ethane represented by the following formulas

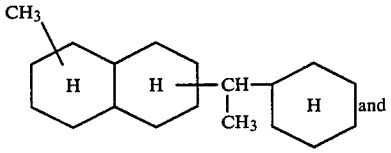

and

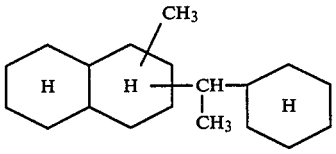

1-(dimethyldecalyl)-1-cyclohexyl ethane represented by the following formulas

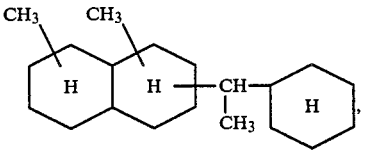

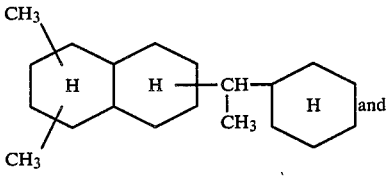

and

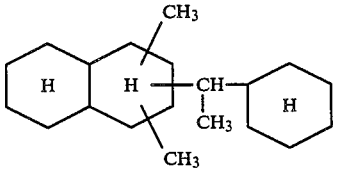

2-decalyl-2-cyclohexyl propane represented by the following formula

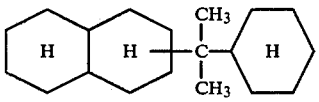

cyclohexylmethyl perhydrofluorene represented by the following formula

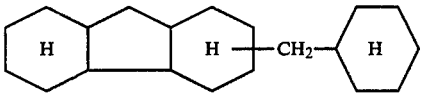

1-perhydrofluorenyl-1-cyclohexyl ethane represented by the following formula

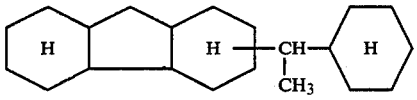

cyclohexylmethyl perhydroacenaphthene represented by the following formula

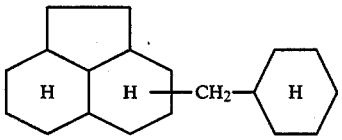

1,1,2-tricyclohexyl ethane represented by the following formula

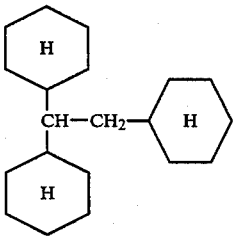

bisdecalin represented by the following formula

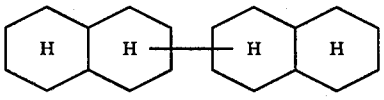

2,4,6-tricyclohexyl-2-methylhexane represented by the following formula

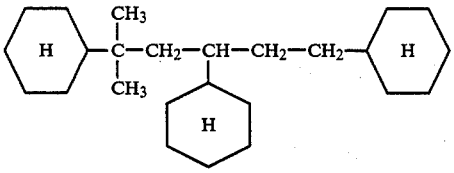

2-(2-decalyl)-2,4,6-trimethylnonane represented by the following formula

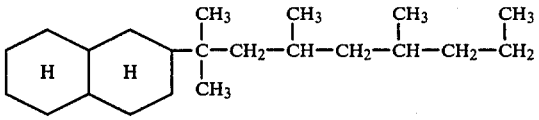

1,1-didecalyl ethane represented by the following formula

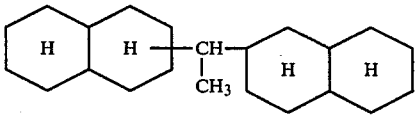

tercyclohexyl represented by the following formula

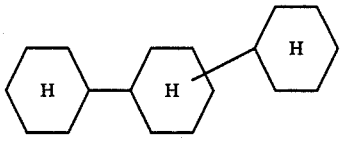

1,1,3-trimethyl-3-cyclohexyl hydrindane represented by the following formula

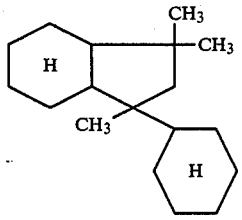

2-methyl-1,2-didecalyl propane represented by the following formula

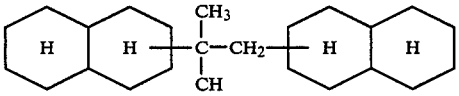

and the like can be enumerated, and they may be used singly or in combination of more than two kinds.

Among the compounds, particularly, 1-decalyl-1-cyclohexyl ethane represented by the following formula is preferable.

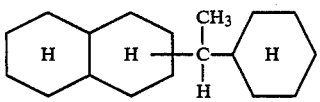

Also, as the compound mentioned above, the compound having much amount of cis-form compound is preferable, and particularly, the compound having more than 50% of cis-form is more preferable.

The (A) component in this invention is the base oil whose main component is the foregoing saturated hydrocarbon having condensed ring and/or non-condensed ring, and in addition, it may contain at a rate of less than 50%, mineral oil, particularly, naphthene mineral oil, synthetic oils such as polybutene, alkylbenzene.

Next, in this invention, as the (B) component, one kind or more than two kinds of zinc dithiophosphate represented by the general formula (I) and/or oxymolbdenum organophosphoro dithioate sulfide represented by the general formula (II) is used.

The zinc dithiophosphate represented by the general formula (I) includes compound of which all the substituents of $R^1$–$R^4$ in the formula are the same to compound of which all the substituents of $R^1$–$R^4$ in the formula are different, and they may be used singly or used in combination of more than two kinds upon mixing thereof. Normally, two kinds or more than two kinds of the zinc dithiophosphate whose substituents of $R^1$–$R^4$ are same are used upon mixing thereof. However, the compound can be used singly, and also, two kinds or more than two kinds of the zinc dithiophosphates having the different four substituents of $R^1$–$R^4$ may be used singly, or the zinc dithiophosphates having the different four substituents of $R^1$–$R^4$ may be used upon mixing with the above compound. Provided that in either cases, it is preferable that the zinc dithiophosphate of the primary alkyl group of 3–30 carbon atoms is presented more than 30% by weight based on the whole zinc dithiophosphates to be used, and particularly, it is preferable to be more than 50% by weight.

As described in the foregoing, when the compound in which the zinc dithiophosphate of the primary alkyl group of 3–30 carbon atoms to the total amount of $R^1$–$R^4$ of the whole zinc dithiophosphate which is present more than 30% by weight based on the whole zinc dithiophosphates is used, its wear resistance and load carrying capacity are improved, and the fatigue life is prolonged and the durability is improved.

As the zinc dithiophosphate of the foregoing type, the compounds already in the market may be used, for example, Lubrizol 1097 made by Nippon Lubrizol KK (the compound in which $R^1$–$R^4$ have primary octyl group as main component), Lubrizol 1395 (the compound in which $R^1$–$R^4$ have a primary butyl group and amyl group as the main components); OLOA 267 made by Kalonite Chemical KK (the compound in which $R^1$–$R^4$ have a primary hexyl group as the main component); Hitec E 682 made by Nippon Couper Co. (the compound in which $R^1$–$R^4$ have a primary hexyl group as the main component); Amoco 198 made by Amono Chemical Inc. (the compound in which $R^1$–$R^4$ have a primary butyl group and amyl group as the main components) are used singly or in combination, and preferably, it may be used by adjusting that the rate of the zinc dithio phosphate in which the substituents $R^1$–$R^4$ are primary alkyl groups is more than 30% by weight based on the whole zinc dithiophosphate, and particularly preferably more than 50% by weight.

Also, in this invention, the oxymolybdenum organo phosphorodithioate sulfide is represented by the general formula (II) which is used as the (B) component together with or instead of one kind or more than two kinds of the zinc dithiophosphate represented by the general formula (I). This oxy metal organo phosphoro dithioate is manufactured by the method described in, for example, Japanese Patent Publication No. 44-27366, and as the concrete compounds, oxymolybdenum diisopropyl phosphoro dithioate sulfide, oxymolybdenum di-isobutyl phosphoro dithioate sulfide, oxymolybdenum di-(2-ethylhexyl)phosphoro dithioate sulfide, oxymolybdenum di-(p-tertiary butylyphenyl)phosphoro dithioate sulfide, oxymolybdenum di-(nonylphenyl)phosphoro dithioate sulfide and the like can be enumerated.

One kind or more than two kinds of zinc dithiophosphate represented by the general formula (I) and/or the oxymolybdenum organo phosphoro dithioate sulfide represented by the general formula (II) which is the (B) component of this invention is the compound having function as an extreme pressure additive (improve of load carrying capacity, wear resistance), and its blending rate is in the range of 0.05–5.0 weight % to the whole composition, and preferably 0.1–2.0 weight %, and more preferably 0.2–1.5 weight %. In case the blending rate is less than 0.05 weight %, the sufficient addition effect does not appear, and on the other hand, it is not possible to expect a remarkable effect even if the blending of more than 5.0 weight % is made, and inversely, showing a tendency of decreased effect.

Also, in this invention, as the (C) component, phosphoric esters, namely, at least one kind of compound from phosphoric ester, phosphorous ester and their amine salts is used.

The phosphoric esters are particularly preferable which are represented by the following general formulas (III) and (IV).

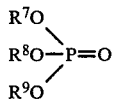
(III)

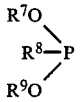
(IV)

In the foregoing formulas (III) and (IV), $R^7$, $R^8$ and $R^9$ denote hydrogen or an alkyl group, aryl group, alkyl substituted aryl group of 4–30 carbon atoms, and $R^7$, $R^8$ and $R^9$ may be same or different.

As a concrete example of the phosphoric esters, phosphoric ester or phosphorous esters such as triphenyl phosphate, tricresyl phosphate, trixylenyl phosphate, tri(isopropylphenyl)phosphate, butyl acid phosphate, 2-ethylhexyl acid phosphate, lauryl acid phosphate, oleyl acid phosphate, stearyl acid phosphate, dibutyl hydrogen phosphite, dioctyl hydrogen phosphite, dilauryl hydrogen phosphite, dioleyl hydrogen phosphite, distearyl hydrogen phosphite, and their amine salts such as laurylamine salt, oleylamine salt, coconut amine salt, beef tallow amine salt and the like can be enumerated.

Among them, particularly, the tricresyl phosphate is preferable.

The phosphoric esters that is the (C) component are blended at the rate of 0.01–5.0 weight % to the whole of the composition, and preferably 0.1–1.5 weight %, and more preferably 0.2–1.0 weight %. When this blending rate is less than 0.01 weight %, the wear resistance is deteriorated and the fatigue life is shortened, and also, when it exceeds 50 weight %, an improvement of addition effect cannot be recognized, and inversely, accelerates the wear which is not preferable.

The lubricant composition for transmission of power of the first invention is composed of three components (A), (B) and (C).

Also, the lubricant composition for transmission of power of the second invention is prepared by blending the rust inhibitor as the (D) component to the first invention.

As the rust inhibitor, various kinds of the compounds can be enumerated. For example, calcium sulfonate, barium sulfonate, sodium sulfonate and in addition, alkyl or alkenyl succinate, its derivative alkylamines such tri-n-butylamine, n-octylamine, tri-n-octylamine, cyclohexylamine or said alkylamine salt or ammonium salt of carboxylic acids such as fatty acid of 6–20 carbon atoms, aromatic carboxylic acid, and dibasic acid of 2–20 carbon atoms, and furthermore, condensates of each of the carboxylic acids and amine can be enumerated. Among them, the calcium sulfonate or barium sulfonate can be preferably used.

The rust inhibitor that is the (D) component is blended at a rate of 0.01–5.0 weight % to the whole composition, preferably 0.05–1.0 weight %, and more preferably 0.1–0.5 weight %. In case the blending rate is less than 0.01 weight %, the rust cannot be prevented, and also, in case the blending rate is more than 5.0 weight %, an improvement of the rust preventing effect cannot be anticipated, and inversely, showing a tendency of deteriorating the wear resistance which is not preferable.

The lubricant composition for transmission of power of this invention is composed of the foregoing (A), (B) and (C) ocmponents or (A), (B), (C) and (D) components, but furthermore, if necessary, proper amount of a variety of additives may be added. For example, phenol antioxidants such as 2,6-ditertiary butyl-p-cresol, 4,4'-methylenebis(2,6-ditertiary butylphenol) and the like can be enumerated. Also, as the pour point depressant or viscosity index improver, polymethacrylate can be enumerated, and particularly, the compounds having number-average molecular weight 10,000–100,000 are preferable. In addition, olefin copolymers such as ethylene-propylene copolymer, styrene-propylene copolymer and the like can be used. These phenol type antioxidants or pour point depressants or viscosity index improver are normally added by 0.1–10.0 weight % to the whole composition.

Besides, proper amount of defoaming agents, extreme pressure additive, oiliness agent, corrosion inhibitor, fatigue life improving agent and the like may be added.

The lubricant composition of this invention consisting of the foregoing component compositions is particularly the composition that improves the durability of metal materials constituting the traction drive mechanisms or gears, bearings and has the performance that can be used for practical purpose.

Namely, the lubricant composition of this invention improves the wear resistance, load carrying capacity of the metal materials constituting the traction drive mechanisms, and has the effect of prolonging the fatigue life. Moreover, the lubricant composition of this invention has excellent oxidation stability, rust preventing property and has no problem such as generation of sludge or of corrosion.

Of course, the lubricant composition of this invention has high traction coefficient and high power transmitting efficiency.

Accordingly, the lubricant composition of this invention can be extremely effectively used not only for the traction drive alone but also, for the lubrication of the traction drive mechanism including the gear mechanism, hydraulic mechanism, rolling-contact bearing and the like, in other words, the power transmission having the traction drive mechanism.

This invention will be described in the following by referring to examples.

EXAMPLE OF PREPARATION (Preparation of base oils A and B):

1000 g of tetralin (tetrahydronaphthalene) and 300 g of concentrated sulfuric acid were placed into a flask made of glass of 3-liter capacity, and the inside temperature of the flask was cooled to 0° C. in ice bath. And then, 400 g of styrene was dropped into the solution for 3 hours while stirring thereof and the reaction was completed in one hour while stirring thereof. Thereafter, the stirring was suspended, and was allowed to stand to separate the oily layer, and this oily layer was washed with 500 cc of IN-aqueous solution of sodium hydroxide and 500 cc of saturated solution of sodium chloride three times each, and then, it was dried by sodium sulfate anhydride. Successively, unreacted tetralin was distilled off, and then, distillation under reduced pressure was carried out to yield 750 g of fraction having boiling point of 135°–148° C./0.17 mmHg. As a result of analysis of this fraction, it was confirmed to be a mixture of 1-(1-tetralyl)-1-phenylethane and 1-(2-tetralyl)-1-phenylethane.

Next, 500 cc of the fraction was placed into an autoclave of 1-liter capacity, and 50 g of activated nickel catalyst for hydrogenation (trade name N-113 Catalyst made by Nikki Chemical Co.) was added, and hydrogenation processing was carried out for 4 hours in the reaction condition of hydrogen pressure of 20 kg/cm$^2$, and reaction temperature of 150° C. After the cooling, the reaction solution was filtered and the catalyst was separated. Successively, light material was stripped from the filtrate, and an analysis of the resulting product showed that a rate of hydrogenation was more than 99.9%, and also this product was confirmed to be a mixture of 1-(1-decalyl)-1-cyclohexylethane and 1-(2-decalyl)-1-cyclohexylethane. A specific gravity of the resulting mixture was 0.94 (15°/4° C.), and dynamic viscosity was 4.4 cSt (100° C.), and also, refraction index $n_D^{20}$ was 1.5032, and cis ratio was 63%. This product was used as the base oil A. Next, the product obtained was made as the base oil B which was prepared by changing the condition of the hydrogenation processing in the method similar to the foregoing to use 5% ruthenium-carbon catalyst, hydrogen pressure of 20 kg/cm$^2$, reaction temperature of 120° C. The base oil B had specific gravity 0.94 (15°/4° C.), dynamic viscosity 4.9 cSt (100° C.), and refractive index $n_D^{20}$ was 1.5048 and cis ratio was 88%.

EXAMPLES 1–10 AND COMPARATIVE EXAMPLES 1–7

As the base oil ((A) component), base oil A, base oil B obtained in the foregoing example of preparation or base oil C (mineral oil) was used, the lubricant composition was prepared by adding the component shown in Table 1 to the base oil ((A) component) at a predetermined rate, and a variety of tests were carried out on the resulting lubricant composition. The results are shown in Table 1. The method of testing is as follows.

Method of testing (1) durability test

The durability test on the Table by a continuously variable speed gear was carried out by using the following apparatus in the following conditions, and the following evaluation was obtained.

apparatus:

Cone-Roller Troidal type continuously variable speed gear described in ASME 83-WA/DSC-33

"Electro-Hydraulic Digital Control of Cone-Roller Toroidal Drive Automatic Power Transmission" . . . T. Tanaka and T. Ishihara conditions:

input shaft revolutions: 3000 rpm input torque: 3.0 kgf-m speed ratio: 1:1 oil temperature: 90° C.

evaluation: Evaluation was made by a total contact frequency till generation of peel-apart of rolling surface. Also, in the remark, result of observation of oil and rolling surface in the middle (after $10^6$ times or at a time of generation of peel-apart) is shown.

(2) fatigue life test

Four steel balls of surface roughness $R_{max}$ 1.5 μm were used in a four-ball testing machine according to JIS K-2519 were used, and the test was carried out in the following conditions.

oil temperature: 80° C.

revolutions: 1500 rpm

Hertz's contact pressure: 711 kgf/mm$^2$ (3) shell four-ball test

In accordance with ASTM D-2785. In Table 1, CL, LWI and WP are defined as follows.

CL . . . corrected load

LWI . . . load-wear index

WP . . . weld point (4) wear resistance

The shell four-ball test of ASTM D-4172 was carried out in the following conditions, and wear amount (mm) was evaluated.

conditions:

revolutions: 1800 rpm load: 30 kg.f time: 2 hours oil temperature: 120° C.

(5) lubricant oxidation stability test for internal combustion engine (ISOT)

The test was carried out in accordance with 3.1 of JIS K 2514 (150° C.×96 hours), and the evaluation was made by presence of sludge on wall surface of a cylinder and change of copper catalyst.

(6) rust preventing property

The test was carried out in accordance with JIS K 2246.

(7) traction coefficient

The test was carried out by 2-cylinder type rolling friction testing machine. Namely, the cylinder A having a curvature (diameter 52 mm, radius of curvature 10 mm) and the cylinder B having flat surface (diameter 52 mm) were made to contact by 7000 gf, and the cylinder A was arranged to run at a fixed speed (1500 rpm) and the cylinder B was arranged to raise the speed from 1500 rpm and the traction force generated between both the cylinders at the slip rate 5% was measured to find the traction coefficient.

The quality of material of the two cylinders was bearing steel SUJ-2, and the surface was finished with buff by alumina (0.03 micron), and the surface roughness was less than $R_{max}$ 0.1 micron, and Hertz's contact pressure was 112 kgf/mm$^2$. The sample oil was kept at 100°·C. by temperature control to make measurement.

TABLE 1

| | | Composition (weight %) | | | | | | | | | Result | | | | | | | | |
|---|---|---|---|---|---|---|---|---|---|---|---|---|---|---|---|---|---|---|---|
| | | (A) Component *1 Base Oil | (B) Component *2 ZnDTP Pri | Sec | Aryl | *3 MoDTP | (C) Component *4 TCP | (D) Component *5 Sulfonate Ca | Ba | Durability Test Durability (times) | Remark | Fatigue life (minutes) | Shell 4 ball CL | LWI | WP | Wear amount (mm) | ISOT Presence of sludge | Change of copper catalyst | Rust preventing property | Traction coefficient |
| Example | 1 | A | 0.5 | — | — | — | 0.5 | — | 0.3 | $10^8$< | good | 130 | 75.2 | 33.5 | 160 | 0.58 | no | no change | no rust | 0.073 |
| | 2 | B | 0.5 | — | — | — | 0.5 | — | 0.3 | $10^8$< | good | 137 | 62.5 | 27.7 | 160 | 0.54 | no | no change | no rust | 0.075 |
| | 3 | B | 0.5 | — | — | — | 0.5 | — | — | — | — | 146 | 62.5 | 27.8 | 160 | 0.57 | no | no change | rust (small) | |
| | 4 | A | — | — | — | 0.5 | 0.5 | 0.3 | — | — | — | 130 | 62.5 | 27.8 | 160 | 0.58 | no | no change | no rust | |
| | 5 | B | 1.0 | — | — | — | 0.5 | 0.3 | — | — | — | 140 | 62.5 | 27.9 | 160 | 0.57 | no | no change | no rust | |
| | 6 | B | 0.4 | 0.2 | — | — | 0.5 | — | 0.3 | — | — | 126 | 62.5 | 27.8 | 160 | 0.58 | no | no change | no rust | |
| | 7 | B | 0.3 | 0.3 | — | — | 0.5 | — | 0.3 | — | — | 120 | 62.5 | 27.9 | 160 | 0.60 | no | no change | no rust | |
| | 8 | B | 0.2 | 0.4 | — | — | 0.5 | — | 0.3 | — | — | 110 | 62.5 | 27.9 | 160 | 0.63 | yes (small) | blackening | no rust | |
| | 9 | B | 0.3 | — | 0.3 | — | 0.5 | — | 0.3 | — | — | 120 | 62.5 | 27.9 | 160 | 0.60 | no | blackening | no rust | |
| | 10 | B | — | 0.5 | — | — | 0.5 | — | 0.3 | $6.1 \times 10^7$ | much wear powder, sludge formed | 103 | 62.5 | 27.9 | 160 | seizure | yes (small) | blackening | no rust | |
| Comparative Example | 1 | B | — | — | 1.0 | — | 0.5 | — | 0.3 | — | — | 96 | 62.5 | 27.9 | 160 | 0.66 | yes (large) | blackening | no rust | |
| | 2 | B | 0.5 | — | — | — | — | 0.3 | — | $4.0 \times 10^7$ | much wear powder | 98 | 62.5 | 27.9 | 160 | 0.66 | no | no change | no rust | |
| | 3 | B | — | — | — | — | 0.5 | 0.3 | — | — | — | 83 | 24.2 | 13.3 | 126 | seizure | yes | no change | no rust | |
| | 4 | A | — | — | — | — | 0.5 | — | — | $9.8 \times 10^6$ | much wear powder | 86 | 29.6 | 15.4 | 126 | seizure | no | no change | rust | |
| | 5 | A | — | — | — | — | — | — | — | $10^6$> | much wear powder, sludge formed | 70 | — | — | — | seizure | solidification | | rust | |
| | 6 | C | 0.5 | — | — | — | 0.5 | 0.3 | — | — | — | 95 | 62.5 | 27.8 | 160 | 0.57 | no | no change | no rust | 0.023 |
| | 7 | product on market (traction oil) | | | | | | | | $2.5 \times 10^7$ | much wear | 79 | 48.8 | 28.8 | 250 | 0.68 | yes (large) | blackening | rust | 0.072 |

TABLE 1-continued

| Composition (weight %) | | | | | | | | | Result | | | | | | | | | | |
|---|---|---|---|---|---|---|---|---|---|---|---|---|---|---|---|---|---|---|---|
| (A) Component *1 Base Oil | (B) Component *2 ZnDTP Pri | Sec | Aryl | *3 MoDTP | (C) Component *4 TCP | (D) Component *5 Sulfonate Ca | Ba | Durability Test Durability (times) | Remark | Fatigue life (minutes) | Shell 4 ball CL | LWI | WP | Wear amount (mm) | ISOT Presence of sludge | Change of copper catalyst | Rust preventing property | Traction coefficient |
| | | | | | | | | | powder | | | | | | | | | |

*1 To the base oil, 5 weight % of polymethacrylate (molecular weight 40,000) was added at a rate against the whole composition.
base oil A: 1-decalyl-1-cyclohexylethane (cis content 63%) represented by the following formula

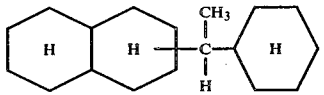

base oil B: Similar to the base oil A, and cis content was 88%.
base oil C: Mineral oil whose dynamic viscosity is 5.32 cSt at 100° C.
2* ZnDTP
Pri: compound whose $R^1$ -$R^4$ are primary hexyl group
Sec: compound whose $R^1$ -$R^4$ are secondary hexyl group
Aryl: compound whose $R^1$ -$R^4$ are dodecyl phenyl group
These ZnDTP was manufactured by following reaction using alcohol as synthetic raw material.

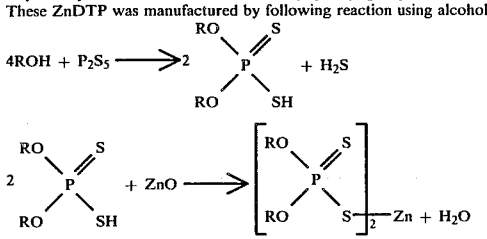

In which as ROH, hexyl alcohol, sec-hexyl alcohol or dodecylphenyl alcohol was used and the foregoing three kinds of ZnDTP were manufactured.
*3 MoDTP
Molyvan L (R. T. Vanderbilt)
4* TCP
Tricresyl phosphate (Dainippon Ink & Chemicals, Inc.)
*5 sulfonate
Ca—sulfonate: Sulfol R-10 (Matsumura Oil Co.)
Ba—sulfonate: NASUL-BSN (R. T. Vanderbilt)

What is claimed is:

1. A traction drive fluid composition comprising (A) as the principal component at least one saturated hydrocarbon selected from those compounds having at least one condensed ring, those having at least one non-condensed ring and those having mixtures of condensed and non-condensed rings; (B) as an extreme pressure additive about 0.05–5.0% by wt. on the composition of at least one member selected from (a) at least one zinc dithiophosphate (b) an oxymolybdenum organophosphorodithioate sulfide and (c) mixtures thereof, said zinc dithiophosphate having the formula

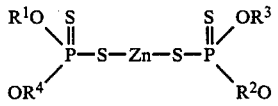

in which $R^1$, $R^2$, $R^3$ and $R^4$ may be the same or different and are selected from a primary alkyl of 3–30 carbons, a secondary alkyl of 3–30 carbons and an aryl or alkyl substituted aryl in which the aryl has 6–30 carbons and said oxymolybdenum organophosphorodithioate having the formula

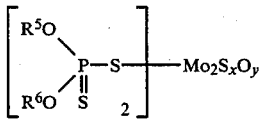

in which $R^5$ and $R^6$ may be the same or different and are selected from an alkyl of 1–30 carbons, a cycloalkyl, an aryl and an alkylaryl, and in which x and y are each a positive real number satisfying $x+y=4$ and (C) about 0.01–5.0% by wt. on the composition of at least one member selected from phosphorus and phosphoric esters and their amine salts.

2. A composition according to claim 1 in which the saturated hydrocarbon is a condensed ring compound having a decalyl group.

3. A composition according to claim 1 in which the saturated hydrocarbon is a non-condensed ring compound having a cyclohexyl group.

4. A composition according to claim 1 in which the saturated hydrocarbon is a condensed/non-condensed ring compound having decalyl and cyclohexyl groups.

5. A composition according to claim 1 in which at least 30% by wt. of the zinc dithiophosphate is zinc dithiophosphate in which $R^1$–$R^4$ are primary alkyl groups of 3–30 carbons.

6. A composition according to claim 1 in which component C is tricresyl phosphate.

7. A composition according to claim 1 including about 0.01–5.0% by wt. on the composition of a rust inhibitor.

8. A composition according to claim 7 in which the rust inhibitor is selected from calcium and barium sulfonate.

9. A process for improving the coefficient of traction between at least two relatively rotatable elements in a torque transmitting relationship which comprises introducing between the tractive surfaces of said elements a traction drive fluid composition comprising (A) as the principal component at least one saturated hydrocarbon selected from those compounds having at least one condensed ring, those having at least one non-condensed ring and those having mixtures of condensed and non-condensed rings; (B) as an extreme pressure additive about 0.05–5.0% by wt. on the composition of at least one member selected from (a) at least one zinc dithiophosphate (b) an oxymolybdenum organophosphorodithioate sulfide and (c) mixtures thereof, said zinc dithiophosphate having the formula

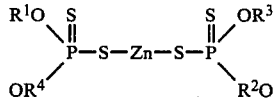

in which $R^1$, $R^2$, $R^3$ and $R^4$ may be the same or different and are selected from a primary alkyl of 3–30 carbons, a secondary alkyl of 3–30 carbons and an aryl or alkyl substituted aryl in which the aryl has 6–30 carbons and said oxymolybdenum organophosphorodithioate having the formula

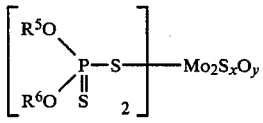

in which $R^5$ and $R^6$ may be the same or different and are selected from an alkyl of 1–30 carbons, a cycloalkyl, an aryl and an alkylaryl, and in which x and y are each a positive real number satisfying $x+y=4$ and (C) about 0.01–5.0% by wt. on the composition of at least one member selected from phosphorous and phosphoric esters and their amine salts.

10. A process according to claim 9 in which the saturated hydrocarbon is a condensed ring compound having a decalyl group.

11. A process according to claim 9 in which the saturated hydrocarbon is a non-condensed ring compound having a cyclohexyl group.

12. A process according to claim 9 in which the saturated hydrocarbon is a condensed/non-condensed ring compound having decalyl and cyclohexyl groups.

13. A process according to claim 9 in which at least 30% by wt. of the zinc dithiophosphate is zinc dithiophosphate in which $R^1$–$R^4$ are primary alkyl groups of 3–30 carbons.

14. A process according to claim 9 in which component C is tricresyl phosphate.

15. A process according to claim 9 including about 0.01–5.0% by wt. on the composition of a rust inhibitor.

16. A process according to claim 15 in which the rust inhibitor is selected from calcium and barium sulfonate.

* * * * *